US009775386B2

(12) United States Patent
Forsythe

(10) Patent No.: US 9,775,386 B2
(45) Date of Patent: Oct. 3, 2017

(54) JEANS WITH INTEGRAL BUTTOCKS PADDING

(71) Applicant: Betty Forsythe, Wilson, NC (US)

(72) Inventor: Betty Forsythe, Wilson, NC (US)

( * ) Notice: Subject to any disclaimer, the term of this patent is extended or adjusted under 35 U.S.C. 154(b) by 0 days.

(21) Appl. No.: 14/606,361

(22) Filed: Jan. 27, 2015

(65) Prior Publication Data

US 2016/0213076 A1 Jul. 28, 2016

(51) Int. Cl.

| | |
|---|---|
| ***A41D 1/06*** | (2006.01) |
| ***A41D 1/14*** | (2006.01) |
| ***A41D 27/26*** | (2006.01) |
| ***A41H 43/00*** | (2006.01) |

(52) U.S. Cl.

CPC ..... *A41D 1/14* (2013.01); *A41D 1/06* (2013.01); *A41D 27/26* (2013.01); *A41H 43/00* (2013.01); *A41D 2300/20* (2013.01); *A41D 2400/38* (2013.01)

(58) Field of Classification Search

CPC .. A41C 1/00; A41B 9/001; A41B 9/00; A41B 9/007; A41B 9/005; A41D 13/00; A41D 1/08; A41D 1/06; A41D 1/027; A41D 7/00; A61F 13/472; A61F 13/496; A61F 13/535; A61F 13/47; A61F 13/512; A61F 13/58; A61F 13/84; A61F 13/53; A61F 13/56; A61F 13/63; A61F 13/539; A61F 5/01

USPC ..... 2/227, 238, 228, 69; 450/98, 99, 94, 97

See application file for complete search history.

(56) References Cited

U.S. PATENT DOCUMENTS

| | | | | |
|---|---|---|---|---|
| 4,894,867 A * | 1/1990 | Ceravolo | A41D 1/08 | 2/227 |
| 4,987,613 A * | 1/1991 | Loverdi | A41D 1/08 | 2/22 |
| 2010/0064409 A1* | 3/2010 | Buckley | A41B 9/001 | 2/67 |

* cited by examiner

*Primary Examiner* — Gloria Hale

(74) *Attorney, Agent, or Firm* — Dale J. Ream

(57) ABSTRACT

The present invention provides a garment for lower parts of the body wherein the garment comprise volume enhancement pads sewn into the interior of buttock area of the garment. The pads provide voluminous look to the buttock of the person wearing the garment. The pads are sewn between the interior surface and lining of the garment such as to blend with the natural curves of the wearer. The stitching pads to the garment provide the advantage of non-slippage of pads during movements of the wearer.

7 Claims, 1 Drawing Sheet

JEANS WITH INTEGRAL BUTTOCKS PADDING

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION

Field of the Invention

The present invention relates to a device for improving the volume and shape of a wearer's posterior. More particularly, the present invention relates to a posterior-form curvature enhancement pad that is sewn into the interior surface of a garment.

Background of Invention

In recent years, both men and women are becoming more fashion conscious. Current fashion trends embrace clothing and apparel designs that increasingly reveal the natural curves of the human body. Particularly, clothing that reveals the abdominal and hip area of the body is generally becoming more popular, such as low rise jeans, which are intended to sit low on or below the hips.

Unfortunately, a large number of the fashion-conscious population may not naturally have the desired shape or proportions that are generally perceived a s visually appealing by most people. Particularly in western fashion, larger or rounder buttock profiles are perceived a s more attractive, and are in fashion. Such people tend to improve their body parts, particularly their faces, breasts, buttocks, and thighs, to obtain a desired figure.

People usually resort to a number of means to enhance their posterior, such as cosmetic surgery, exercise or diet, filling foam material into their garments, etc. These methods have their own advantages and disadvantages, and the choice of a particular method depends on the user's requirement and the risk involved. Cosmetic surgery for buttock augmentation involves inserting fat or implants to increase the volume of and reshape the buttocks. The method is very risky and expensive. Moreover, there are chances of failure and long-term side effects.

Exercise and diets are the safest means to enhance the bodily parts and improve posture; however, alone they are of limited use. For example, flat buttocks could only be slightly enhanced by diet and exercise. Moreover, it requires a considerable length of time, and the same diet and exercise may not work for all.

Inserting filler material into garments is the most common method to enhance a particular part of the body. Pads made of sponge, silicone, or fibers are inserted in the posterior area of the garment to make them look larger. However, such pads cause the buttocks to appear artificial and cause discomfort to the user. This may happen due to the shape of the pad not conforming to or blending into the natural curves of the wearer's body. Furthermore, the clothing may lack adequate means of attaching the padding to the clothing, which causes the pad to move from its desired position, causing an unnatural look and discomfort to the user. These types of problems increase with an increase in movement or other activities, resulting in pad slipping. This could be particularly embarrassing if the user is wearing hipster or low-rise garments.

The prior art discloses many attempts to improve the design of pads, as well as means to fix the pad onto the inside of garment. One prior art discloses a garment for covering the lower body portion of the person. This disclosure includes two pockets positioned respectively adjacent the buttocks of the wearer. Filling pads are inserted into the pockets to make their position stationary. However, it is difficult to insert the pad in a pocket in a uniform shape, thus giving artificial look. Moreover, the pad may slip from the pocket during physical activity.

In view of aforesaid problems, there is a need for an improved method for customizing garments with pads.

BRIEF SUMMARY OF THE INVENTION

The present invention discloses a garment, for covering the lower body portion that has foam pads to enhance the buttocks.

Another objective of the invention is to fulfill the foregoing objects by providing a garment with pad wherein the pads do not slip.

Certain embodiments of current invention provide a figure-enhancing garment that is used to cover the lower portion of the body, wherein the buttock area of the garment is customized with curvature enhancement pads that provides a voluptuous or well-proportioned look to the buttocks. The pads are sewn between the interior surface of a multiple layer attire and an inner lining means of the garment. The garment includes any surface shell attire as jeans, trousers, pants, shorts, and the like. The pads could be made of sponge, silicon, fabrics, or any another material. The invention is not limited to these embodiments.

According to another embodiment of the present invention, the figure-enhancing garment is used to cover the lower body portion. The garment may include jeans, trousers, pants, shorts, and the like.

According to another embodiment of current invention, the pads are sewn between the interior surface of a multiple layer attire and the inner lining means of the garment.

According to another embodiment of current invention, the pads could be made of sponge, silicon, fabrics, or any another material creating an additional volume.

According to another embodiment of current invention, the pads are a shape and size that blends with the natural curves of the user.

According to another embodiment of current invention, the pads are stitched into the inner surface of a surface shell attire around the siting area of garment such that stitching marks are not visible on the outer surface of the garment.

In addition to the various objectives and advantages of the present invention, described with some degree of specificity above, it should be obvious that additional objectives and advantages of the present invention will become more readily apparent to those persons who are skilled in the relevant art from the following more detailed description of the invention, particularly when such description is taken in conjunction with the attached drawing figures.

BRIEF DESCRIPTION OF THE FIGURES OF THE DRAWINGS

To further clarify various aspects of some example embodiments of the present invention, a more particular description of the invention will be rendered by reference to specific embodiments thereof, which are illustrated in the appended drawing. It is appreciated that the drawings depict only illustrated embodiments of the invention, and are, therefore, not to be considered limiting of its scope. The invention will be described and explained with additional specificity and detail through the use of the accompanying drawing, in which.

DETAILED DESCRIPTION OF THE INVENTION

The terminology used herein is for the purpose of describing particular embodiments only, and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

For the sake of simplicity and to give the claims of this patent application the broadest interpretation and construction possible, the conjunctive "and" may also be taken to include the disjunctive "or," and vice versa, whenever necessary. Likewise, when the plural form is used, it may be taken to include the singular form, and vice versa.

It will be understood that, although the terms first, second, third, etc. may be used herein to describe various elements, these elements should not be limited by these terms. These terms are only used to distinguish one element from another element.

The disclosure herein is not limited by construction materials to the extent that such materials satisfy the structural and/or functional requirements. For example, any material may be used so long as it satisfies the rigid structural and functional requirements for which it is being used. In one embodiment, the device and/or system is steel or a similar metal or alloy; however, polymeric material of sufficient strength and rigidity will suffice as well.

Before explaining at least one embodiment of the invention in detail, it is to be understood that the invention is not limited in its application to the details of construction and the arrangements of the components set forth in the following description. The invention is capable of other embodiments, and of being practiced and carried out in various ways.

Figure 1:
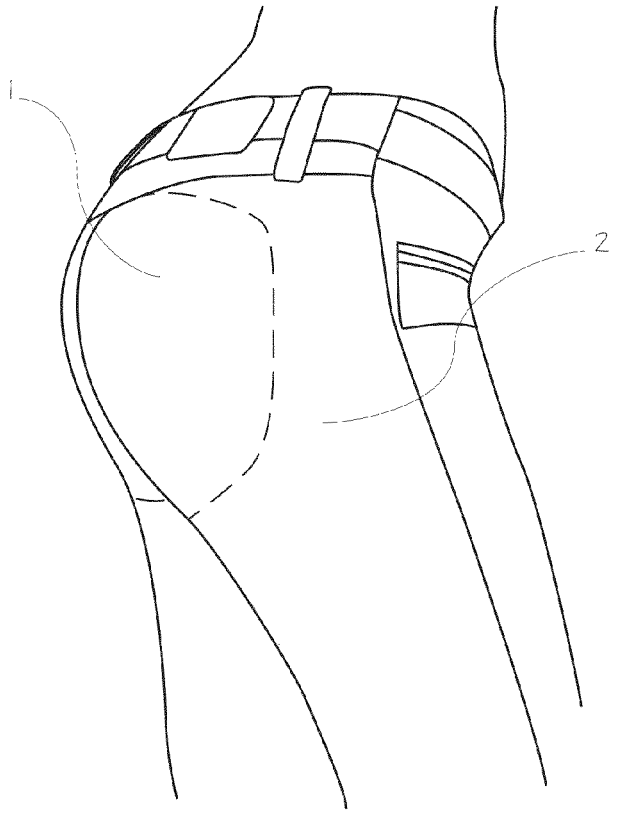
FIG. 1 depicts a perspective view of a garment in accordance with the current invention.
Figure 2:
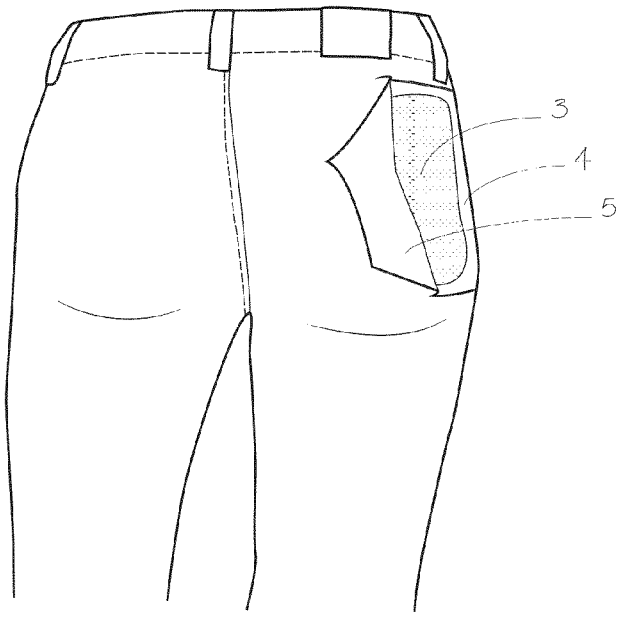
FIG. 2 depicts a posterior view of jeans with pads sewn onto the inner surface, in accordance with the current invention.

The present invention provides a garment with pads in the posterior buttock area of the garment for enhancing the appearance of the buttocks. Referring to FIG. 1, the pads 1 are permanently sewn onto the interior surface of the buttock area of garment 2. The garment includes bottoms attire such as, but not limited to, jeans, pants, trousers, skirts, etc. Preferably, garments with tight fitting are preferable, as they closely fit to the body. The pads are permanently sewn so that they do not move from their position, thus providing comfort to the user; moreover, fixing the pads looks more natural and saves the user from inserting and adjusting the pads every time. The buttock area of the garment is customized with curvature enhancement pads that provide a voluptuous or well-proportioned look to the buttocks. FIG. 2 illustrates the posterior view of tight fitting jeans with pads 3 sewn between the inner lining means 4 and the inner surface material of the multiple layer attire 5 onto the buttock area. The pads result in a voluptuous or well-proportioned and natural look.

The pads could be made from materials such a sponge, silicone or fabric; the pads are of shape and size to match the contours of the buttock area of user, so that they easily blend with natural curves of the user, thus making the invention more user-friendly.

The curvature pads form a lining layer and are permanently sewn with the inner surface or interior portion of the garment. The pads are stitched such that the outer surface of the garments does not show any visible stitching marks. The user does not have to purchase anything extra which makes the present invention more economic. The foregoing has outlined, rather broadly, the preferred feature of the present invention so that those skilled in the art may better understand the detailed description of the invention that follows.

Those skilled in the art should appreciate that they can readily use the disclosed conception and specific embodiment as a basis for designing or modifying other structures for carrying out the same purposes of the present invention, and that such other structures do not depart from the spirit and scope of the invention in its broadest form.

I claim:

1. A figure enhancing lower body garment for changing the shape appearance of a buttocks of a person wearing the garment, comprising:

a lower body buttocks covering garment having a multi-layer construction of an outer layer having an interior surface and an inner lining, said lower body buttocks covering garment outer layer including a buttock covering area having an interior surface;

a pair of posterior enhancing pads permanently attached to said interior surface creating a unitary construction therewith;

said lining lying over said posterior buttocks enhancing pads and sandwiched between said inner lining and said interior surface of said buttocks covering area such that said pads are unmovable and unremovable from said buttocks covering area of said lower body buttocks covering.

2. The figure enhancing garment as in claim 1, wherein said garment is taken from a group consisting of jeans, pants, trousers, and skirts.

3. The figure enhancing garment as in claim 1, wherein said pads are attached to said inner surface of said buttock covering area via stitching that is not visible on an outer surface of said buttock area.

4. The figure enhancing garment as in claim 1, wherein respective pads define a geometric volume that changes a curvature of the buttock of a wearer of said lower body buttocks covering garment.

5. The figure enhancing garment as in claim 1, wherein said pair of posterior enhancing pads includes a left pad laterally spaced apart from a right pad.

6. The figure enhancing garment as in claim 1, wherein said pair of posterior enhancing pads form a layer of the multi-layer construction of said lower body buttocks covering garment between said inner lining and said interior surface of said buttock area.

7. The figure enhancing garment as in claim 1, wherein said pair of pads is constructed of a material taken from a group consisting of a sponge, silicon, and fabric.

* * * * *